US008033792B1

(12) United States Patent
Morando

(10) Patent No.: US 8,033,792 B1
(45) Date of Patent: Oct. 11, 2011

(54) HIGH FLOW/HIGH EFFICIENCY CENTRIFUGAL PUMP HAVING A TURBINE IMPELLER FOR LIQUID APPLICATIONS INCLUDING MOLTEN METAL

(76) Inventor: Jorge A. Morando, Solon, OH (US)

( * ) Notice: Subject to any disclaimer, the term of this patent is extended or adjusted under 35 U.S.C. 154(b) by 0 days.

(21) Appl. No.: 13/037,019

(22) Filed: Feb. 28, 2011

Related U.S. Application Data

(63) Continuation of application No. 12/239,228, filed on Sep. 26, 2008, now Pat. No. 7,896,617.

(51) Int. Cl.
*F04D 7/06* (2006.01)

(52) U.S. Cl. ..... 416/182; 416/186 R; 416/243; 29/889.4

(58) Field of Classification Search ..... 416/179, 416/182, 185, 186 R, 223 B, 243; 29/889.4
See application file for complete search history.

(56) References Cited

U.S. PATENT DOCUMENTS

| | | | | |
|---|---|---|---|---|
| 3,482,523 | A | 12/1969 | Morando | |
| 3,776,660 | A | 12/1973 | Anderson et al. | |
| 4,454,078 | A | 6/1984 | Engelbrecht et al. | |
| 4,491,474 | A | 1/1985 | Ormesher | |
| 4,518,424 | A | 5/1985 | Ormesher | |
| 5,192,193 | A | 3/1993 | Cooper et al. | |
| 5,634,770 | A | 6/1997 | Gilbert et al. | |
| 5,944,496 | A * | 8/1999 | Cooper | 416/223 R |
| 6,082,965 | A | 7/2000 | Morando | |
| 6,354,796 | B1 | 3/2002 | Morando | |
| 6,457,940 | B1 | 10/2002 | Lehman | |
| 6,468,039 | B1 * | 10/2002 | Lehman | 416/181 |
| 7,144,217 | B2 * | 12/2006 | Gilbert et al. | 415/121.2 |

* cited by examiner

*Primary Examiner* — Igor Kershteyn
(74) *Attorney, Agent, or Firm* — Steve M. Clemmons

(57) ABSTRACT

A centrifugal pump having a turbine impeller having a plurality of curved vanes. The vanes curve from the inlet end to the outlet end in the direction of pumping rotation of the impeller, such that the leading wall of each vane re-directs a portion of the radial velocity of the fluid flowing through the passage to increase the total tangential velocity provided by the impeller. Each vane includes a cavity which entrains fluid which slides back from a spinward passage and redirects the entrained fluid back in the direction of rotation.

19 Claims, 9 Drawing Sheets

HIGH FLOW/HIGH EFFICIENCY CENTRIFUGAL PUMP HAVING A TURBINE IMPELLER FOR LIQUID APPLICATIONS INCLUDING MOLTEN METAL

CROSS-REFERENCE TO RELATED APPLICATION

This application is a continuation of U.S. patent application Ser. No. 12/239,228 filed Sep. 26, 2008, now U.S. Pat. No. 7,896,617.

FIELD OF THE INVENTION

This invention relates to molten metal pumps. More particularly, this invention relates to a centrifugal pump impeller suited for use in a molten metal pump.

BACKGROUND AND SUMMARY OF THE INVENTION

A typical molten metal facility includes a furnace with a pump for moving molten metal. During the processing of molten metals, such as aluminum, the molten metal is normally circulated through the furnace by a centrifugal pump to equalize the temperature of the molten bath and to transfer the molten metal out of the pump. These pumps contain a rotating impeller that draws in and accelerates the molten metal creating a laminar-type flow within the furnace.

The impeller of the present invention is particularly well suited to be used in molten aluminum and molten zinc pumps. In fact, throughout the specification, numerous references will be made to the use of the impeller in molten aluminum pumps, and certain prior art molten aluminum pumps will be discussed. However, it should be realized that the invention can be used in any pump utilized in refining or casting molten metals.

In the processing of molten metals, it is often necessary to move molten metal from one place to another. When it is desired to remove molten metal from a vessel, a so called transfer pump is used. When it is desired to circulate molten metal within a vessel, a so called circulation pump is used. When it is desired to purify molten metal disposed within a vessel, a so called gas injection pump is used. In each of these types of pumps, a rotatable impeller is disposed within a pumping chamber in a vessel containing the molten metal. Rotation of the impeller within the pumping chamber draws in molten metal and expels it in a direction governed by the design of the pumping chamber.

In most centrifugal pumps, the pumping chamber is formed in a base housing which is suspended within the molten metal by support posts or other means. The impeller is supported for rotation in the base housing by means of a rotatable shaft connected to a drive motor located atop a platform which is also supported by the posts.

Molten metal pump designers are generally concerned with efficiency, effectiveness and longevity. For a given diameter impeller, efficiency is defined by the work output of the pump divided by the work input of the motor. An equally important quality of effectiveness is defined as molten metal flow per impeller revolutions per minute. Generally speaking, improved efficiency of the metal flow is achieved by making the pump exit velocity as high as necessary to efficiently discharge the metal so as to penetrate the metal pool outside the pump, while maintaining the pump as small as possible.

Typically, conventional impellers have much larger outlet openings than the inlet opening's size due to the impeller's diametral increase from the radially inward inlet to the outwardly located outlet, this increase in opening size normally results in a dramatic reduction in the radial velocity component of these prior impellers.

My present invention improves efficiency and flow by increasing the total velocity of the fluid exiting the impeller of a centrifugal pump. This increase in output velocity of the pumped fluid is achieved by curving the impeller passages towards the direction of rotation of the impeller. The curved passages maintain a specially configured cross-sectional area and shape through the length of the passage to ensure that there is no significant loss in the radial velocity of the fluid (created by the rotation of the impeller) other than inherent losses attributed to changing from axial flow to radial flow as the fluid travels through the passage. The forwardly directed passages in combination with the size of the passages results in the re-direction of the majority of the radial velocity component into the tangential direction, thereby increasing the total pump outlet velocity and assuring higher flows at equal volute cross-sectional areas compared to traditional impeller designs.

The present invention increases flow approximately 25% over my prior U.S. Pat. No. 7,326,028 entitled HIGH FLOW/DUAL INDUCER/HIGH EFFICIENCY IMPELLER FOR LIQUID APPLICATIONS INCLUDING MOLTEN METAL, which is incorporated herein in its entirety, which provided flow rates of 2000 gallons of molten aluminum per minute at 300 rpm for a 16 inch diameter impeller. The present invention achieves approximately 2500 gal/min at 300 rpm using only a 14 inch diameter impeller. Further my prior impeller produced head coefficients (k) between 0.52-0.54, while I am now able to achieve approximately 0.55-0.57 with my present invention.

Another troublesome aspect of molten metal pump operation is the degradation of the impeller. Moreover, to operate in a high temperature, abrasive molten metal environment, a refractory or graphite material is used from which to construct the impeller because of their inert qualities. However, these materials are also prone to degradation when exposed to particles entrained in the molten metal. More specifically, the molten metal may include pieces of the refractory lining of the molten metal furnace, undesirable material from the metal feed stock and occlusions which develop via chemical reaction or metallurgical combination, all of which can cause damage to an impeller and pump housing if passed therethrough.

My present centrifugal pump impeller has fluid passages that have a cross-sectional area and shape that absolutely gradually increases from the inlet openings all the way to the outlet opening. This progressive area and shape ensures that any particulate matter (e.g., dross) that finds its way into the impeller will pass through the impeller and will not become lodged in the rotating impeller, thereby avoiding a catastrophic failure of the pump.

The novel impeller has a generally cylindrical shape and is formed of a refractory material such as graphite or a ceramic such as silicon nitride silicon carbide. The cylindrical piece includes a hub surrounding a cavity in its upper face suitable to accommodate a shaft. The shaft, in turn, is joined to a motor to achieve rotation of the impeller. The periphery of the upper face is machined to include a plurality of passages which extend downwardly and outwardly from the upper face to the sides of the cylindrical impeller.

Importantly, each of the impeller passages is curved toward the direction of the impeller's rotation and has a gradually increasing cross-sectional area and shape. Maintaining this type of passage and curving the passage toward the direction of rotation re-directs the radial velocity of the flowing liquid to add its velocity to the tangential velocity imparted on the flow by the rotating shaft-impeller assembly. In one preferred embodiment, five passages are formed and provide a large inlet fluid volume area.

Further, the passages are formed such that they provide a "tunnel" at the upper face of the impeller after a cover plate is provided or when the impeller is ceramic casted (having an integral "top plate" formed thereon), which effectively provides entrainment of any particular particles (that are smaller than the inlet openings) entering the impeller and prevents lodging/jamming between the rotating impeller body and the pump housing. In this manner, any inclusions or scrap contained in the molten metal which is small enough to enter this zone of the passage will of necessity be sized such that it can exit the impeller.

It is an advantage of the present invention to provide a centrifugal pump impeller system for pumping fluid, including molten metal, comprising an impeller adapted for rotating about an axis in a certain pumping direction of rotation. The impeller comprising a circular and generally flat base and a plurality of vanes mounted to the base. The vanes extending radially from a radially inward portion of the base to an outer-most edge of the base, each vane having a concave leading wall and a convex trailing wall, the trailing wall of each vane cooperating with the leading wall of an adjacent vane to define the next curved passage. Wherein the trailing wall of each vane is complementary in shape to the adjacent leading wall, such that the passage has a gradually increasing cross-sectional area from a radially axial inward inlet to a radially outward outlet, and wherein the impeller is rotatable about a central axis such that fluid flowing through each passage follows the curved leading wall into the same general direction as the pumping direction of rotation. The curved passage walls adding a portion of the radial velocity of the fluid to the tangential velocity of the flow to increase the total velocity of the fluid exiting the impeller.

It is another advantage of the present invention to receive the fluid exiting from the impeller which would ordinarily drag against the outer surface of the impeller into a cavity formed in the outer surface of each vane. Each cavity traps and guides this fluid along a curved wall which redirects the fluid into the same general direction as the pumping direction of rotation, thereby adding a portion of the redirected fluid's radial velocity to the tangential velocity of the flow to increase the total velocity of the fluid exiting the impeller.

These and other objects, features and advantages of the present invention will become apparent from the following description when viewed in accordance with the accompanying drawings and appended claims.

BRIEF DESCRIPTION OF THE DRAWINGS

The description refers to the accompanying drawings in which like reference characters refer to like parts throughout the several views, and in which.

DETAILED DESCRIPTION OF THE INVENTION

Figure 1:
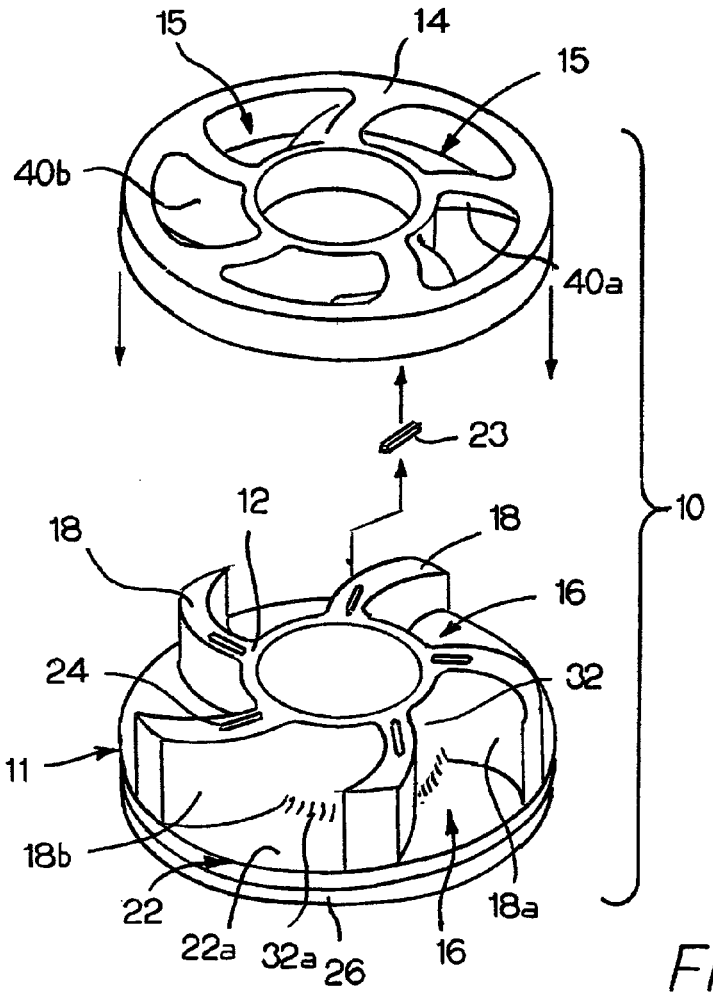
FIG. 1 is a perspective, partially exploded view of a turbine impeller illustrating the preferred embodiment of the invention.

Reference will now be made in detail to the present preferred embodiment of the invention, an example of which is illustrated in the accompanying drawings. While the invention will be described in connection with the preferred embodiment, it will be understood that it is not intended to limit the invention to that embodiment. On the contrary, it is intended to cover all alternatives, modifications and equivalents that may be included within the spirit and scope of the invention defined by the appended claims.

Referring now to FIGS. 1-4, the inventive impeller 10 is a generally cylindrical shaped body 11 of graphite or ceramic and includes an upper face 12 having a recess 13 to accommodate a shaft. A top plate 14 having a plurality of axial inlet openings 15 is fixed to the upper face 12. Each inlet 15 is in fluid communication with a passage 16 in the body 11 which extend axially downward from a passage inlet 15 from the upper face and radially outward between a pair of spaced vanes 18, to an outlet opening 20. The lower portion or base 22 of the impeller is generally flat and circular. Each vane 18 projects generally vertically away from base 22, while each passage 16 has a bottom wall defined by an upper face **22*a* of the circular base 22**.

Figure 3:
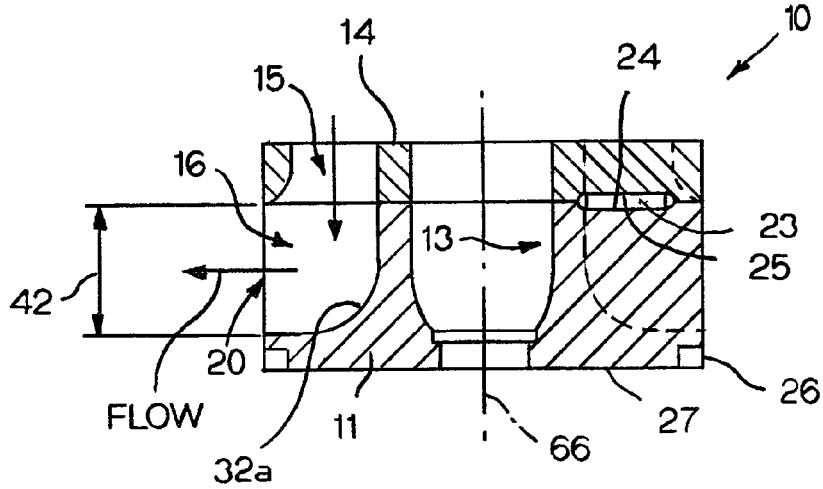
FIG. 3 is a sectional view of the impeller generally through line 3-3 in FIG. 2, but including the top plate.

The ceramic top or wear plate 14 is attached to the top surface 12 of the impeller 10 so that the two components rotate as a unit. As best shown in FIG. 3, a plurality of keys 23 cooperates with complementary-shaped channels or keyways 24 and 25 formed in the top surface 12 and the bottom surface of plate 14.

To improve the wear characteristics of the device, a bearing ring 26 of a ceramic, such as silicon nitride bonded silicon carbide, is provided surrounding the outer edge of a lower face 27. To that end, the ceramic wear plate 14 and the bearing ring 26 provide opposing wear surfaces sandwiching the impeller body 11.

Figure 2:
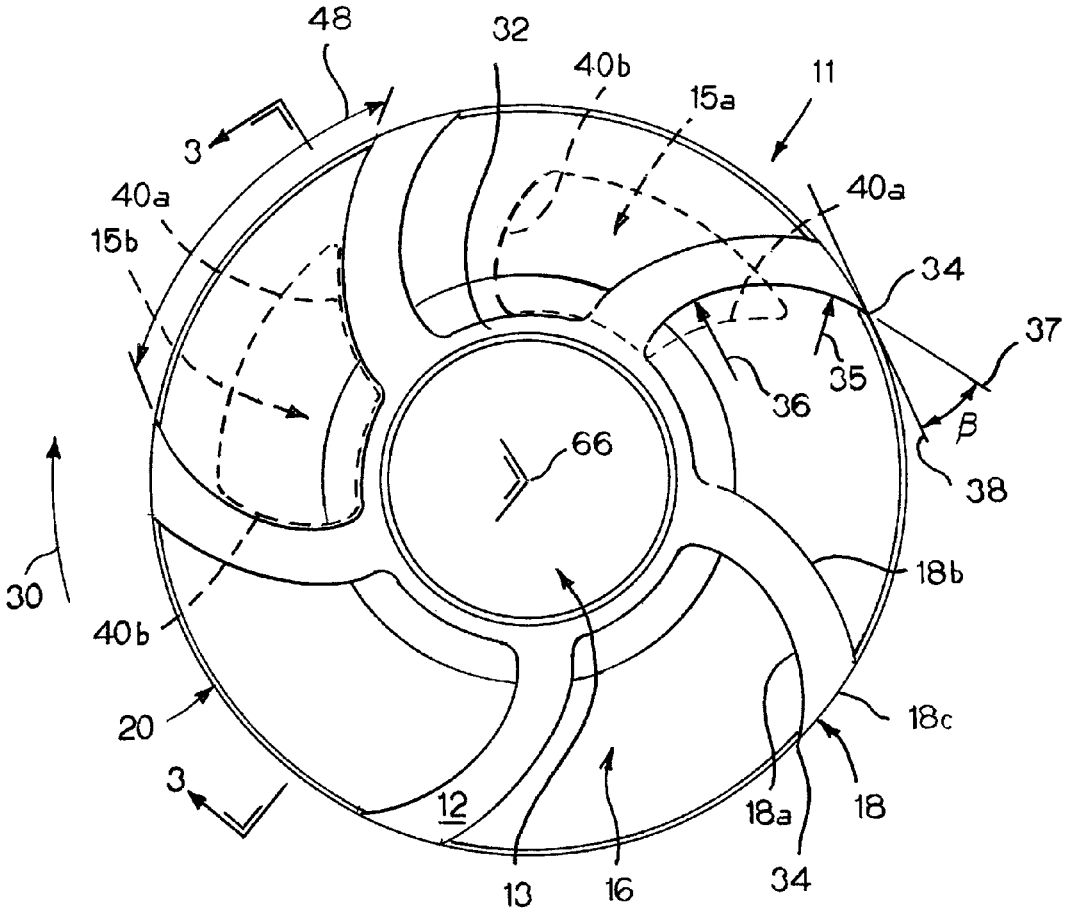
FIG. 2 is a top plan view of the impeller body.
Figure 4:
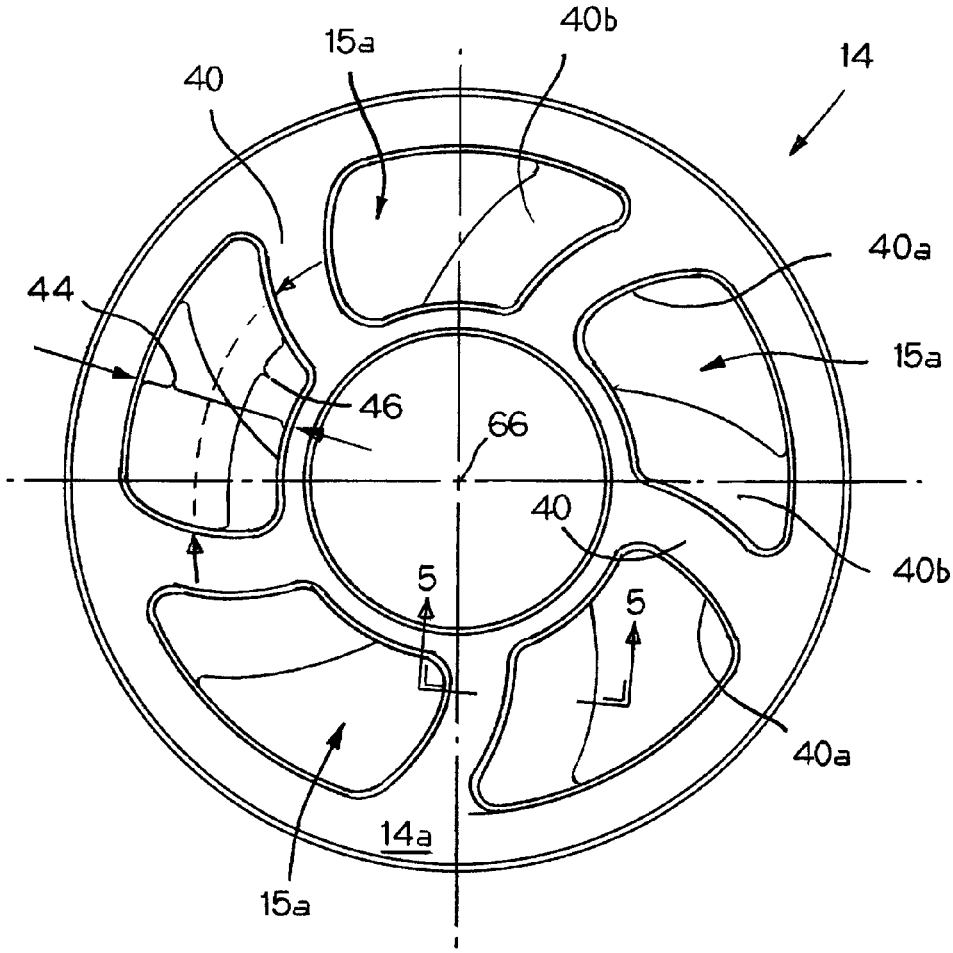
FIG. 4 is a top plan view of the top plate.

With specific reference to FIGS. 2 and 3, the passages 16 have a controlled and gradually increasing cross-sectional area from the inlet 15 to the outlet 20. That is, the cross-sectional area of inlets 15, passages 16, and outlets 20 are preselected in both the height component and the width component (i.e., the vertical/height and horizontal/width components at outlet 20). As will be discussed in greater detail below, the height of passage 16 and its width at outlet 20 are determined based on an optimized ratio between the outlet area and inlet area.

It should be appreciated that the controlled size and shape of the passage from inlet 15 to outlet 20 will beneficially ensure that the radial velocity imparted on the liquid flowing through the rotating impeller 10 will not be dramatically reduced while passing through the passage 16. Further, the configuration of passage 16 ensures that any particle which can enter the impeller will also exit.

Importantly, by providing a vane passage that conserves the metal flow's radial velocity and adds it to the tangential velocity, the present invention departs from conventional spiral-type impeller design. A flow of liquid passing through a centrifugal pump impeller has both a radial velocity component (the velocity away from the axis of rotation) and a tangential velocity component (the velocity in the direction of rotation). Conventional spiral-type impellers have vane passages which gradually increase in cross-sectional size out to their outlets. This increase in passage area inherently results in the slowing of the liquid flowing therethrough in the radial direction. The amount the flow slows is approximately equal to the ratio between the inlet size to the outlet size. The larger the outlet, relative to the inlet size, the slower a given flow of liquid will pass out of the impeller radially. The present invention, by providing a controlled passage size and smooth transitions as the flow is redirected minimizes this slow down of the radial velocity component. It should be appreciated that the present impeller does not decrease the passage size through the impeller to avoid additional acceleration losses and contaminants from lodging within the constricted passage.

As shown in the FIGS., the impeller body has a plurality of vanes 18 mounted in an annular array with an equal angular distance between each pair of vanes. The vanes are preferably constructed and arranged to dynamically balance the impeller. The vane walls 18*a* and 18*b* of adjacent vanes define the sides of curved passages 16. The number of vanes can number three as a minimum with a maximum dictated by the size of the largest contamination solid that is generally encountered in a metal furnace. In the non-limiting embodiment illustrated in the FIGS., five vanes 18 are provided, resulting in five passages 16.

As shown in FIG. 2, the impeller illustrated is configured to be rotated in the clock-wise direction shown by arrow 30. In this embodiment, each vane 18 extends radially from an annular central hub 32 that contains recess 13. Each vane 18 includes a leading wall 18*a* and a trailing wall 18*b* with respect to the direction of rotation. That is, when the impeller is rotated clockwise, the leading wall 18*a* will pass a given point outside of the impeller before trailing wall 18*b*. An outer peripheral wall 18*c* depends from the outer-most edges of walls 18*a* and 18*b*. These peripheral walls 18*c* preferably further depend from and are an extension of the radially outer surface of the circular base 22.

Importantly, the leading wall 18*a* has a concave or cup-like shape. Wall 18*a* is preferably a continuous curve starting at hub 32, eliminating any sharp turns or obstructions to fluid flow along its radial length. The radially outer end of wall 18*a* preferably curves to a greater degree than the remaining radially inward wall surface and terminates at a point at leading edge 34 where wall 18*a* meets peripheral wall 18*c*. As shown in FIG. 2, the radius 35 at the radially outward portion of wall 18*a* is preferably smaller than the radius 36 of the inward portion of the same wall.

This inwardly curling configuration of wall 18*a* causes the line 37 that is tangent to the wall 18*a* at leading edge 34 to form an acute angle β with the tangent line 38 of the peripheral wall 18 (and base 22) at leading edge 34. In the preferred embodiment, angle β is within the range of 15-45 degrees to maximize the redirection of the radial velocity of the flow exiting each passage 16 toward the direction of the tangential velocity in a smooth and controlled manner.

The trailing wall 18*b* of each adjacent vane is complementary in shape to the leading wall 18*a* of the adjacent vane. That is, the trailing wall 18*b* which cooperates with a leading wall 18*a* to co-define each particular passage 16 is shaped to maintain the desirable size and shape that minimizes radial velocity losses throughout the passage 16 as described above. Trailing wall 18*b* is therefore convex in shape and curves as it extends radially away from the axis of rotation. The exact shape (i.e., curvature) of the trailing wall 18*b*, of course, depends on the shape of the adjacent leading wall 18*a*, and the particular requirement under considerations (e.g., whether the pump-type is a recirculation, transfer, or gas-dispersion).

It should be appreciated that the initial gradual curve of wall 18*a* and the subsequent sharper curve at the outward end reduces the overall size of each vane 18. In one embodiment, each passage may start at the inward end in a generally straight manner, projecting away from the axis of rotation, then curving as the passage nears the outlet 20.

The idea is to control the direction of the exit flow from the impeller, and to optimize its exit velocity by controlling the exit angle of the liquid flowing out of the passages 16. The novel concave curvature of the leading walls 18*a* (and passages 16) results in the axial velocity of the flow from a rotating impeller to be partially directed in a tangential direction to the direction of rotation. The flow's radial velocity component in the tangential direction is thereby added to the tangential velocity of the flow to increase the total velocity of the liquid exiting the impeller. The smaller the angle β, the greater the added increase in tangential velocity from the radial velocity component of the impeller. You can then control the characteristics of the pump by defining the direction and velocity of the exiting fluid metal.

Figure 5:
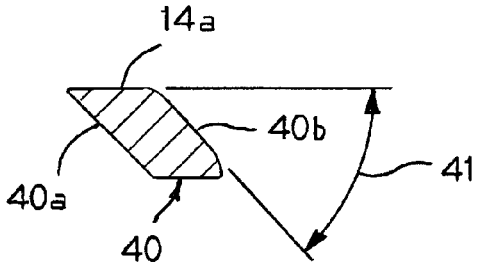
FIG. 5 is a sectional view of the top plate arm through line 5-5 in FIG. 4.
Figure 6:
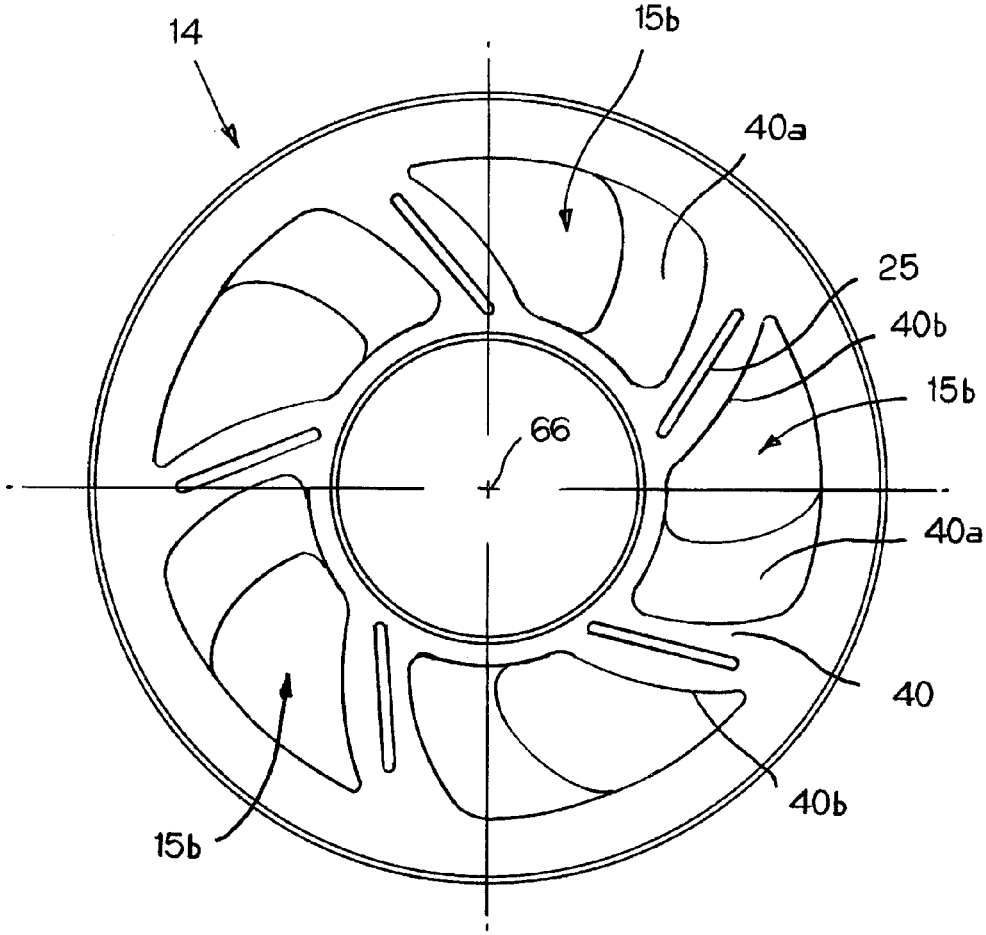
FIG. 6 is a bottom plan view of the top plate.

Referring now to FIGS. 2 and 4-6, the top plate 14, includes a plurality of tapered inlet openings 15. Unlike traditional impeller inlet openings, which simply provide a through hole in fluid communication with the impeller's passages, the present invention configures the inlets 15 to reduce losses in velocity as the flow enters the impeller through the inlets. Particularly, each inlet 15 is defined by the leading wall 40*a* and trailing wall 40*b* of adjacent radially spaced arms 40. As shown in FIG. 5, these walls 40*a*, 40*b* angle down and away from the top surface 14*a* of plate 14 in the direction opposite to the direction of rotation. The angle 41 the two walls 40*a*, 40*b* angle away from surface 14*a* is in the range of 40 to 50 degrees.

Additionally, each inlet's leading and trailing walls 40*a*, 40*b* preferably terminate at and follow the curved contour of the impeller vane 18. That is, and is best shown in FIG. 2 in phantom, the bottom edges of walls 40*a* and 40*b* are coterminous to by both meeting and blending into the vane walls 18*b* and 18*a*, respectively to create a smooth transition to the vane area entrance. It should be appreciated that the angled leading and trailing walls 40*a*, 40*b* result in the inlet opening at the top surface 14*a* of the top plate, denoted 15*a* in FIG. 2, to be positioned ahead of the portion of inlet 15 where the inlet 15 meets passage 16, denoted 15*b*.

It has been determined that the present invention's angling of the leading and trailing inlet walls 40*a*, 40*b* and by blending the inlets 15 into the vane walls 18*a*, 18*b*, the top plate beneficially directs the flow of the material passing into the impeller with minimal losses in velocity. To that end, substantially all locations where intersection walls meet are preferably rounded or curved to reduce eddy losses. For example and without limitation, body 11 includes a gradual fillet 32*a* where hub 32 meets surface 22*a* to redirect the flow from a substantially axial direction to the radial direction.

To minimize losses in radial velocity, the inventor of the present invention has determined that a ratio of the area, Ao, of the outlet opening 20 to the area, Ai, of the inlet opening 15 optimally falls within the range of 1.20 to 1.40. Furthermore, the height 42 of the passages 16 must remain constant and should also be greater than both the inlet opening width 44 and the its length 46 at the center (radially) of the inlet.

Figure 7:
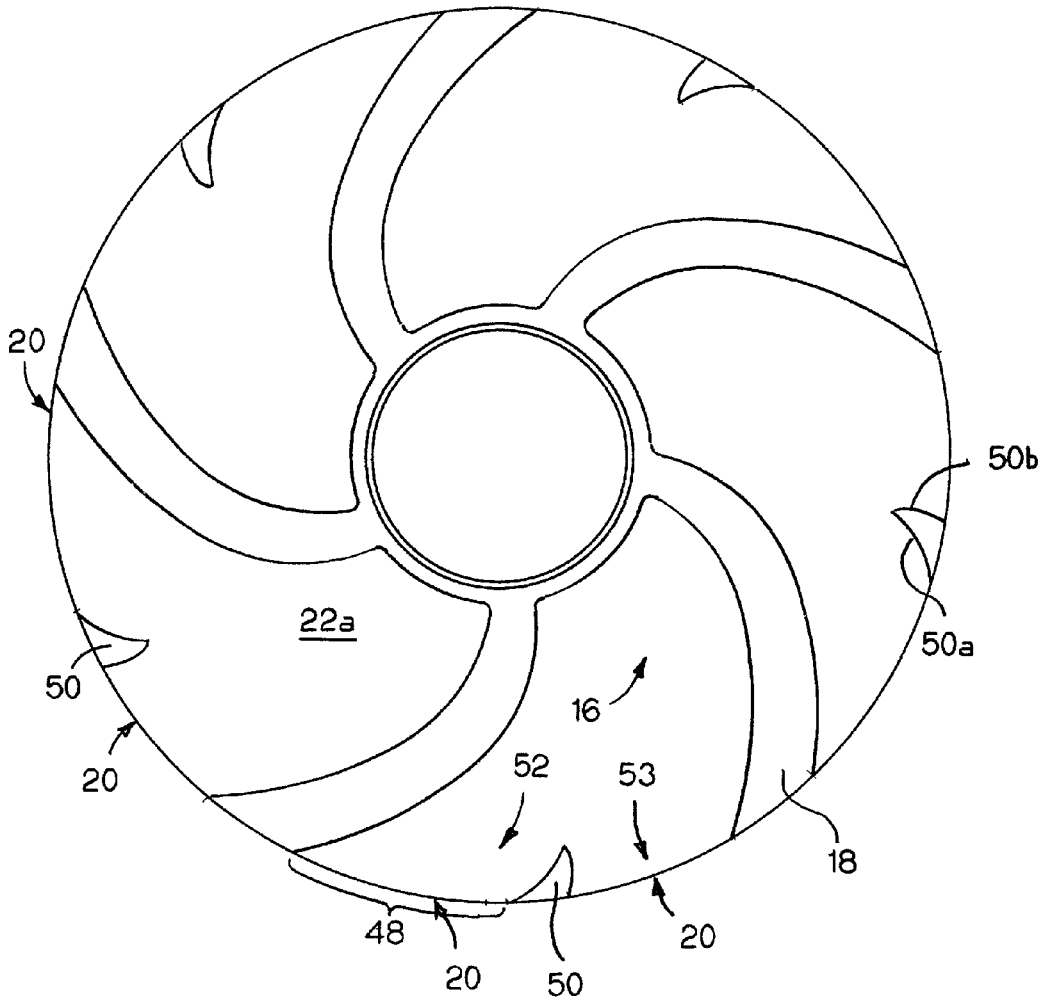
FIG. 7 is a top plan view of an impeller body including intermediate vanes.

As describe above, if the width 48 of each vane passages outlet opening 20 is too large (typically when the diameter of the impeller increases) the radial velocity of the flow is reduced. To overcome this disadvantage either additional vanes 18 may be incorporated if there is sufficient space to generate the desired flow rate, or and as is shown in FIG. 7 an intermediate vane 50 may be inserted within each passage 16 to effectively divide each passage 16 in half at the outlet 20.

Each intermediate vane 50 extends up from surface 22*a* up to top plate 14 and terminates radially at the outer diameter of body 11 in substantially the same manner as vanes 18, however each intermediate vane 50 only partially extends into passage 16. The leading and trailing walls 50*a* and 50*b* are shaped substantially the same as the leading and trailing vane walls 18*a*, and 18*b*, but walls 50*a*, 50*b* meet within passage 16 to direct flow into the sub-divided passages 52, 53. In this manner, the intermediate vanes 50 will reduce the width 48 of each outlet 20, thereby allowing the passage height 42 to be enlarged, which increases the flow rate of the impeller.

Figure 8:
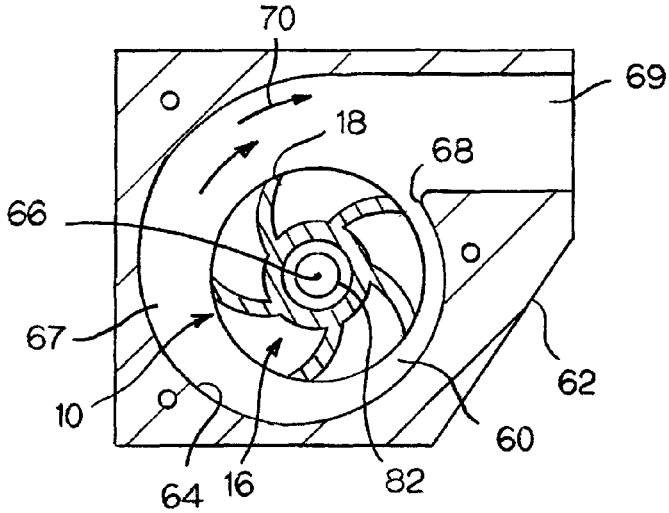
FIG. 8 is a top sectional view of the impeller inserted within the centrifugal impeller base housing.

Referring to FIG. 8 impeller 10 is disposed at least partially within an impeller chamber 60 in a pump base housing 62 and includes a spiral volute wall 64 formed about the axis of rotation 66 of the shaft and defining a spiral volute passage 67. As is well known, a spiral volute passage 67 increases in diameter from cutwater point 68 of the volute to the pump exit opening 69. The liquid flowing through the volute passage exits through the base exit opening 69 shown in FIGS. 8 and 9. The metal moves in the volute passage in a horizontal plane, in the direction of shaft rotation indicated by arrow 70.

The liquid metal passes downwardly and axially through the five identically sized and shaped top plate inlets 15 and then radially outwardly into the base volute passage 67, as shown in FIG. 8.

The volute inlet at cutwater 68 has an area larger than inlet 15 to permit large solids carried in the metal to pass through the pump without damaging the pump. The clearance as well as the volute shape are established by the well-known design procedures outlined in pump design books such as *Centrifugal Pumps Design & Application* by Val S. Labanoff and Robert R. Ross or *Centrifugal and Axial Flow Pumps* by A J. Stepanoff, 2$^{nd}$ Edition 1957.

Figure 9:
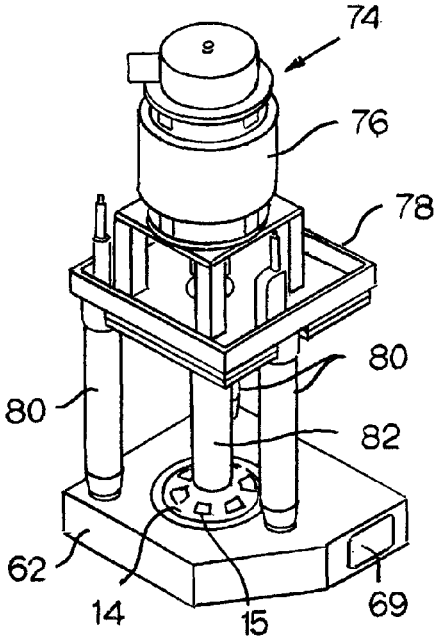
FIG. 9 is a perspective view of a centrifugal pump employing the turbine impeller.
Figure 10:
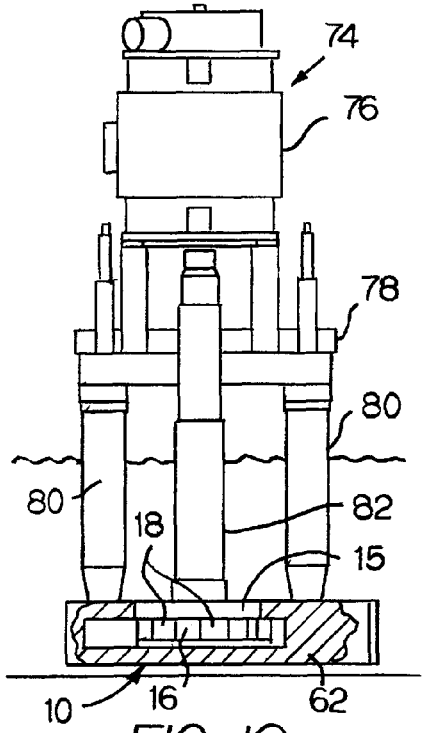
FIG. 10 is a partial cut-away side view of the pump of FIG. 9.

FIG. 9 depicts the arrangement of the impeller 10 in a molten metal pump 74. Particularly, a motor 76, is secured to a motor mount 78. Three refractory posts 80 are secured to the motor mount 78. At a second end, each of the posts 80 is cemented into a base housing 62. The base 62 includes a pumping chamber or volute 60, in which the impeller 10 is disposed. The impeller is rotated within the pumping chamber via a shaft 82 secured to the motor typically by a threaded connection. Of course, the skilled artisan is aware of many various coupling designs such as, but not limited to, pinned connections and lobed drives which are all suitable for use in the present pump.

Figure 11:
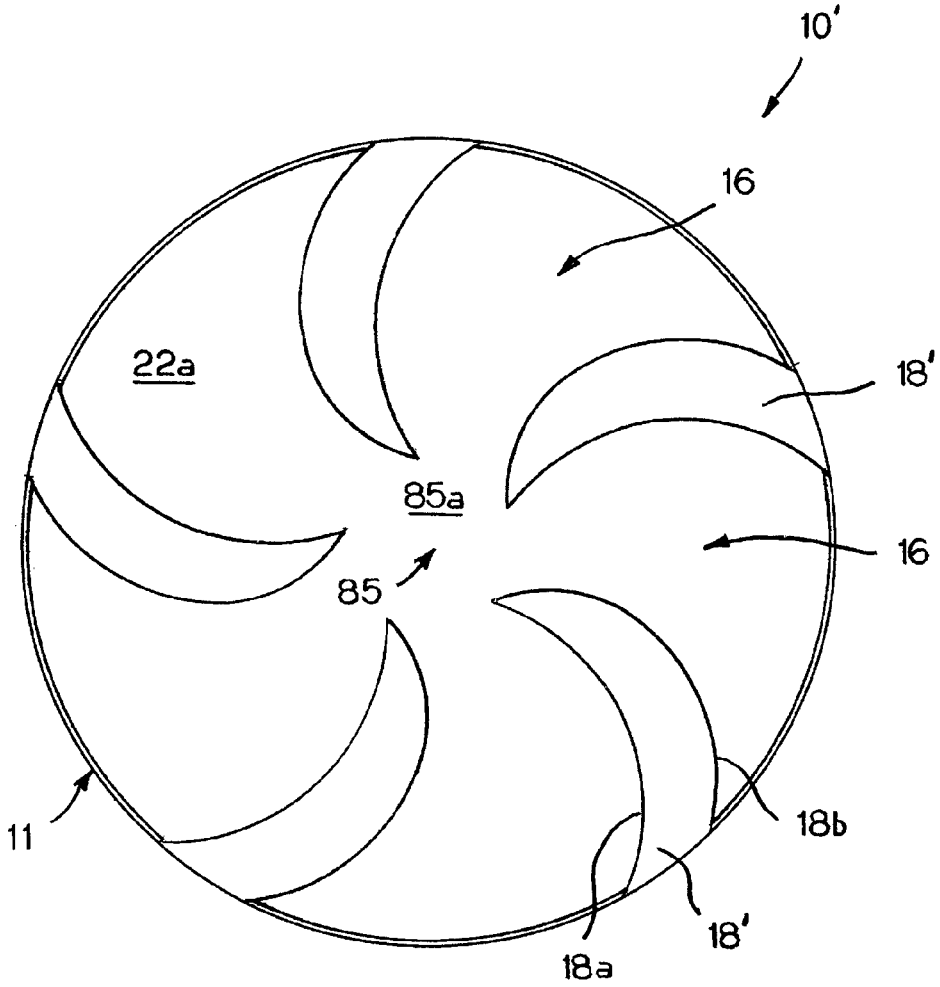
FIG. 11 is a top plan view of an alternate bottom suction configured impeller eliminating the central hub from the side having the impeller's vanes.

In an alternate embodiment for a "bottom suction" type of pump, illustrated in FIG. 11, impeller 10' eliminates the annular central hub 32 of impeller 10. Instead, each vane 18' has the leading wall 18*a* and the trailing wall 18*b* meet at an inward end in substantially the same way as intermediate vanes 50. In the embodiment shown, a large central opening 85 is fluidly connected to each passage 16. The bottom surface 85*a* is co-planar with impeller surface 22*a* that forms the bottom wall of the passages 16. Central opening 85 receives flow from plate inlets 15 (not shown). It should be appreciated that in this bottom suction configuration, the "top" plate of impeller 10' is in actuality located at the bottom end of the impeller body 11 and that the body 11 receives the input shaft from a hub similar to hub 32 extending from the opposite surface of surface 22*a*. In this embodiment, the wear plate will typically have more inlets 15 than passages 16 as the absence of shaft 82 and hub 32 from the side of body 11 having passages 16 increases the space available to receive incoming flow. In incoming flow is then distributed through the radially inward portions of each passage 16 as the impeller rotates.

Figure 12:
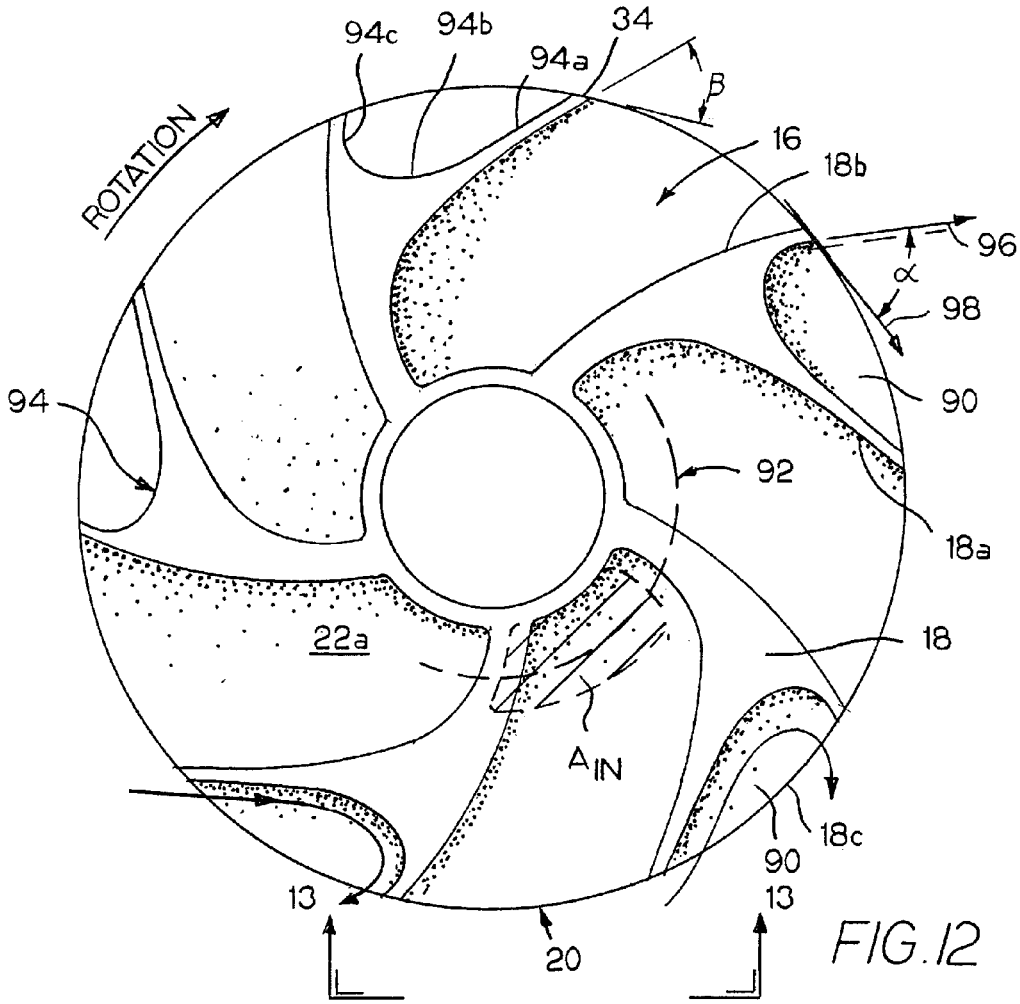
FIG. 12 is a top plan view of an alternate impeller body.
Figure 13:
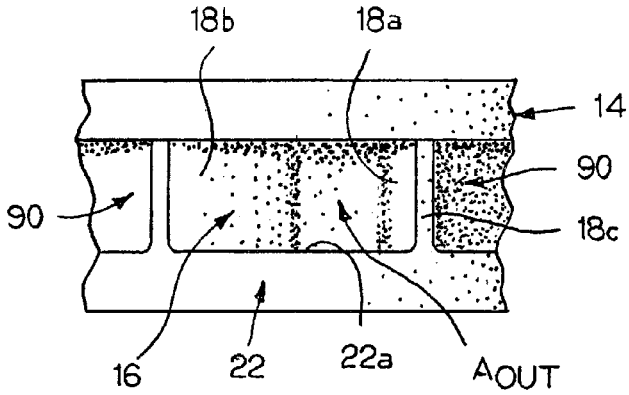
FIG. 13 is a side view through line 13-13 of FIG. 12.

Referring now to FIGS. 12 and 13, an alternate embodiment of the invention is illustrated with each vane 18 having a viscous drag cavity 90. This embodiment is particularly suited to transfer-type pumps where the ratio of the impeller's outside diameter to the inlet mean diameter, shown by line 92 is typically greater than two and the area Aout of outlet 20 exceeds the area Ain of inlet 15 above the 1.40 ratio discussed above. To correct this non-optimum outlet to inlet ratio, each vane 18 is widened, such that the outer peripheral wall 18*c* is enlarged to decrease the outlet area Aout to bring the ratio Aout/Ain to fall within the range of 1.20 to 1.40.

To reduce the effects of viscous drag which typically occurs in impellers having enlarged outer peripheral vane walls, each vane 18 includes a viscous drag cavity 90 formed into its outer wall 18*c*. Each cavity 90 includes a continuous curved wall 94. Each wall 94 starts adjacent to the leading edge 34 of the vane. This forward or leading wall portion 94*a* falls radially inward into the vane, the wall 94 includes a concave portion 94*b*, which curves back toward the periphery of the impeller. The rear or trailing wall portion 94*c* curves back to wall 18*c* and follows an arcuate path which is substantially the same curvature as the leading walls 18*a*, such that the angle $\alpha$ formed by the line 96 that is tangent to portion 94*c* at outer wall 18*c* and the tangent line 98 is approximately equal to the angle $\beta$ of the leading wall 18*a* at each leading edge 34.

In operation, each of the viscous drag cavities 90 functions very much like a viscous drag pump. To that end, each cavity 90 prevents the fluid exiting outlet 20 from "sliding back" during rotation and creating turbulence which affects the output of the next outlet. Instead, the fluid is pulled into the cavity by the suction action of portion 94*a* forcing the fluid to fill cavity 90 while rotating with the impeller. The entrained/trapped liquid then follows the curvature of wall 94 exiting at a higher velocity due to the previously described radial velocity into tangential velocity effect of the curved vane/cavity walls. In other words, each cavity 90 acts as a velocity booster, taking fluid which would ordinarily reduce the total velocity (e.g., by creating turbulence) and redirecting or "kicking" this fluid out back into the generally direction of rotation.

Figure 14:
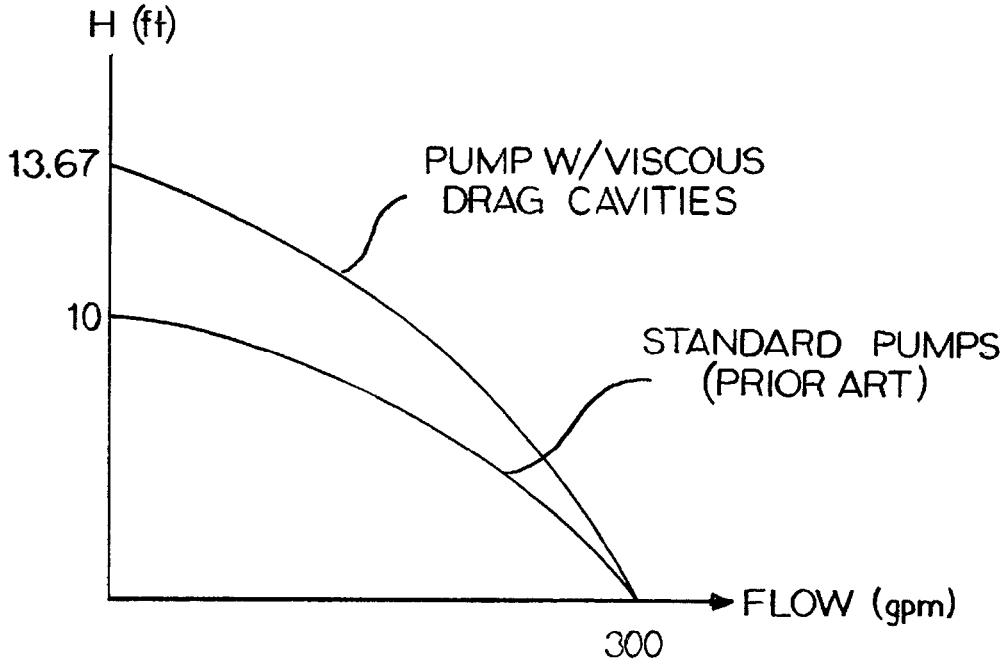
FIG. 14 is a graph of the head in feet vs. the flow in gallons per minute produced for like-sized traditional centrifugal impellers and the alternate impeller shown in FIGS. 12 and 13.

It should be appreciated that this embodiment does not increase the total flow of the pump since the inlet area Ai is not changed, but instead and as is shown in FIG. 14, the outlet pressure in enhanced with pressure coefficients as high as k=0.82 vs. k=0.60 in standard centrifugal pumps.

From the foregoing description, one skilled in the art will readily recognize that the present invention is directed to a centrifugal pump having an improved impeller configuration which increases output velocities and efficiency and a method of making a centrifugal pumping system using the same to improve pump flow and efficiency. While the present invention has been described with particular reference to various preferred embodiments, one skilled in the art will recognize from the foregoing discussion and accompanying drawing and claims that changes, modifications and variations can be made in the present invention without departing from the spirit and scope thereof.

The invention claimed is:

1. A centrifugal pump impeller system for pumping fluid, including molten metal, comprising:

an impeller adapted for rotating about an axis in a certain pumping direction of rotation, comprising:

a circular and generally flat base; and a plurality of vanes mounted to the base, the vanes extending radially from a radially inward portion of the base to an outer-most edge of the base, each vane having a concave leading wall, a convex trailing wall, and an outer peripheral wall depending from and interconnecting the leading wall and trailing wall, the trailing wall of each vane cooperating with the leading wall of an adjacent vane to define a curved passage, wherein the trailing wall of each vane is complementary in shape to the adjacent leading wall, such that the passage has a gradually increasing cross-sectional area from a radially inward inlet to a radially outward outlet;

wherein each outer peripheral wall includes a viscous drag cavity having a rearward arcuate wall which has substantially the same curvature as each vane's leading wall;

wherein said impeller is rotatable about a central axis such that fluid flowing through each passage follows the curved leading wall into the same general direction as the pumping direction of rotation.

2. A centrifugal pump impeller system as defined in claim 1, wherein each leading wall terminates at a leading edge, the tangent of the curved leading wall at the leading edge forming an angle with the tangent of the base edge at the leading edge, wherein the angle is in the range of 15 to 45 degrees.

3. A centrifugal pump as defined in claim 1, wherein the curved shape of the passages add a portion of a radial velocity of the fluid flowing through each passage to a tangential velocity of the fluid imparted by rotation of the impeller in the certain pumping direction of rotation.

4. A centrifugal pump as defined in claim 1, wherein the curved shape of the viscous drag cavities entrain fluid back sliding from the passage that is immediately spinward of each drag cavity.

5. A centrifugal pump impeller system as defined in claim 1, wherein said impeller further includes a top plate mounted to the vanes opposite to said base, wherein said inlets are formed in the top plate.

6. A centrifugal pump impeller system as defined in claim 5, wherein each inlet is defined by a plurality of radially extending arms, each having a leading wall and a trailing wall, wherein a trailing wall of and leading wall of adjacent arms are both coterminous with one of the convex trailing vane wall and the concave leading vane wall of each vane passage, respectively.

7. A centrifugal pump impeller system as defined in claim 1, wherein a ratio between the area of each outlet and the area of each inlet is in the range of 1.20 to 1.40.

8. A centrifugal pump impeller system as defined in claim 1, wherein the viscous drag cavity for each vane has a forward wall which is adjacent to the leading wall of that vane, wherein said forward wall and rearward define a continuous curved viscous drag wall.

9. A centrifugal pump for pumping fluid, including molten metal, comprising:

a pump framework;

a pump motor mounted on the pump framework;

a pump housing attached to the pump framework, the pump housing having an impeller chamber and an exit opening fluidly connected to the impeller chamber for discharging a fluid therethrough;

an impeller shaft attached to and rotated by the pump motor;

an impeller structure attached to the impeller shaft to be rotated about an axis in a certain direction of rotation and mounted within the impeller chamber, the impeller structure comprising:

a circular and generally flat base;

a plurality of vanes mounted to the base, the vanes running radially away from an inward portion of the base adjacent to the axis to a circular outer-most edge of the base, each vane having a leading wall, a trailing wall, and an outer peripheral wall depending from and interconnecting the leading wall and trailing wall, the trailing wall of each vane cooperating with the leading wall of an adjacent vane to define a passage;

wherein the leading wall of each vane is concave, while the trailing wall of each vane is convex and complementary in shape to the adjacent passage-defining leading wall, whereby each passage has a constant height and a gradually increasing cross-sectional area and curves toward the direction of rotation terminating at an outlet opening;

wherein each outer peripheral wall includes a viscous drag cavity having a curved rearward wall which has substantially the same curvature as each the leading wall.

10. A centrifugal pump as defined in claim 9, wherein said leading wall curves toward and terminates at an outer-most leading edge, the tangent of the curved leading wall at the leading edge forming a certain first angle with the tangent of the base edge at the leading edge, wherein said first angle is in the range of 15 to 45 degrees.

11. A centrifugal pump as defined in claim 10, wherein said rearward wall curves toward and terminates at an outer-most viscous drag cavity edge, the tangent of the curved rearward wall at the viscous drag cavity edge forming a certain second angle with the tangent of the base edge at the viscous drag cavity edge, wherein said second angle is approximately equal to said first angle.

12. A centrifugal pump as defined in claim 9, wherein the viscous drag cavity in each vane has a forward wall which is adjacent to the leading wall of that vane, wherein said forward wall and rearward define a continuous curved viscous drag wall.

13. A centrifugal pump as defined in claim 12, wherein the leading walls and trailing walls are both curved continuously from the inward portion to the base edge.

14. A centrifugal pump as defined in claim 9, wherein said impeller further comprises a top plate mounted to the vanes opposite to the base, the top plate including a plurality of inlet openings, each of which is fluidly aligned with an inner end of each passage, wherein a ratio of the area of each outlet opening to the area of each inlet opening is in the of 1.20 to 1.40.

15. A centrifugal pump as defined in claim 14, wherein each of said inlet openings is defined by a plurality of radially extending arms, each having a leading wall and a trailing wall, wherein a trailing wall of and leading wall of adjacent arms are both coterminous with one of the convex trailing vane wall and the concave leading vane wall of each vane passage, respectively.

16. A centrifugal pump as defined in claim 11, wherein the curved shape of the passages redirects the fluid flowing through each passage to a tangential velocity of the fluid imparted by rotation of the impeller structure in the certain direction of rotation and wherein the curved shape of the viscous drag cavities entrains fluid back sliding from the passage that is immediately spinward of each drag cavity and redirects said entrained fluid back out along said second angle.

17. A method of making a centrifugal pump for pumping a fluid, including molten metal, comprising the steps of, but not necessarily in this order of:

providing a base having an impeller chamber;

fluidly connecting the impeller chamber to a base exit opening for discharging a fluid therethrough;

rotatably mounting an impeller structure in the impeller chamber;

connecting a shaft to the impeller structure for rotation therewith about an axis in a certain direction to discharge a fluid from the base exit opening;

providing the impeller structure with a plurality of passages which curve from an inner end to an outer end toward the direction of rotation, thereby adding a portion of a radial fluid velocity to a tangential fluid velocity out of the impeller structure; and providing the impeller structure with a viscous drag cavity between each adjacent passage, said drag cavities each have a rearward wall which curves toward the direction of rotation and entrain and redirect any fluid back sliding from the immediately spinward passage toward the direction of rotation.

18. A method as defined in claim 17, further comprising the step of providing the impeller structure with a plurality of curved radially extending vanes that are spaced apart around a central axis, wherein each of said plurality of passages are defined by adjacent vanes, wherein each of said viscous drag cavities is formed within a radially outermost surface of said vanes.

19. A method as defined in claim 18, wherein the step of providing the impeller structure with a plurality of passages further comprises: causing each of the passages to have a gradually increasing cross-sectional area.

* * * * *